US007571923B2

(12) United States Patent
Baumgartner et al.

(10) Patent No.: US 7,571,923 B2
(45) Date of Patent: Aug. 11, 2009

(54) DEVICE FOR POSITIONING A SKIBINDING ON A SKI

(75) Inventors: Manfred Baumgartner, Lichtenworth (AU); Karl Stritzl, Vienna (AU); Gernot Jahnel, Katzelsdorf (AU)

(73) Assignee: Tyrolia Technology GmbH (AT)

( * ) Notice: Subject to any disclaimer, the term of this patent is extended or adjusted under 35 U.S.C. 154(b) by 307 days.

(21) Appl. No.: 11/521,112

(22) Filed: Sep. 14, 2006

(65) Prior Publication Data

US 2007/0063484 A1 Mar. 22, 2007

(30) Foreign Application Priority Data

Sep. 16, 2005 (EP) ..... 05108554

(51) Int. Cl.
*A63C 9/00* (2006.01)

(52) U.S. Cl. ..... 280/611; 280/613; 280/616; 280/626; 280/629; 280/633; 280/634

(58) Field of Classification Search ... 280/14.21–14.24, 280/611, 613, 616, 626, 629, 633, 634
See application file for complete search history.

(56) References Cited

U.S. PATENT DOCUMENTS 3,950,001 A * 4/1976 Weigl ..... 280/618
4,185,852 A * 1/1980 Himmetsberger et al. ... 280/618
4,620,719 A * 11/1986 Stritzl ..... 280/633
4,773,669 A * 9/1988 Peyre ..... 280/632
4,896,896 A * 1/1990 Riegler et al. ..... 280/618
4,955,633 A 9/1990 Stritzl et al.
5,085,456 A * 2/1992 Horn ..... 280/618
5,096,218 A * 3/1992 Bardin ..... 280/633
5,209,516 A * 5/1993 Arduin et al. ..... 280/633

(Continued)

FOREIGN PATENT DOCUMENTS

AT 411 735 10/2003

(Continued)

OTHER PUBLICATIONS

European Search Report issued Feb. 20, 2006.

*Primary Examiner*—Christopher P Ellis
*Assistant Examiner*—Jacob Meyer
(74) *Attorney, Agent, or Firm*—Ostrolenk Faber LLP

(57) ABSTRACT

A ski binding having two ski-binding parts is positioned on a ski, which bears guide devices for arranging the two ski-binding parts for sliding action, it being possible for each ski-binding part to be connected to an, in particular strip-like connecting element, which connecting elements can be secured in relation to the ski, between the two ski-binding parts, by means of a locking device which is fixed relative to the ski and has at least one blocking lever which can be engaged with, and disengaged from, toothing formations provided laterally on the connecting elements. The at least one blocking lever is mounted on a carrier part, which can be connected to the ski and remains connected to the ski when the spacing between the ski-binding parts is changed, such that it can be rotated about an axis running transversely to the longitudinal direction of the ski and in a plane parallel to the top side of the ski, and pivoting allows the blocking lever to be engaged with, and disengaged from, the toothing formations of the connecting elements.

6 Claims, 4 Drawing Sheets

U.S. PATENT DOCUMENTS

Figure 1:
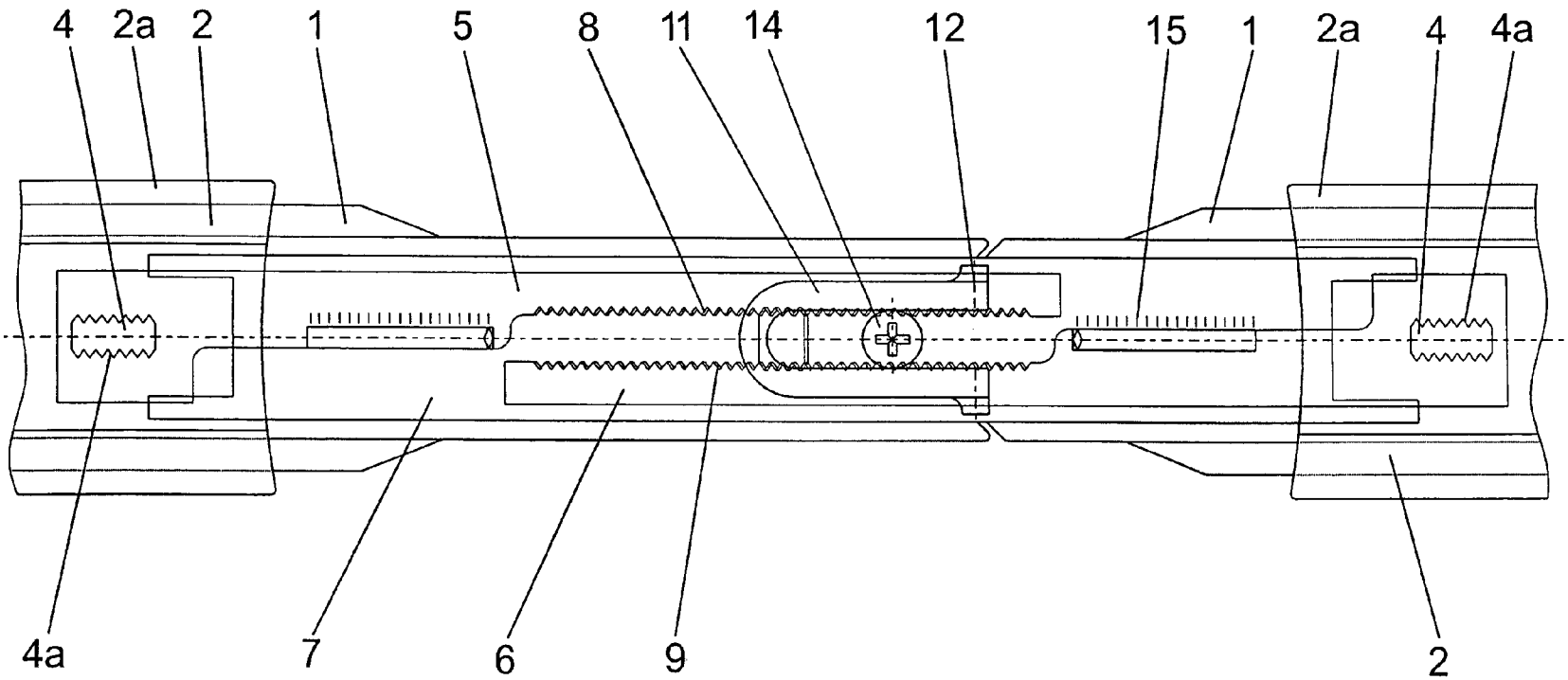

| | | | | | |
|---|---|---|---|---|---|
| 5,261,688 | A | * | 11/1993 | Rohrmoser | 280/617 |
| 5,344,178 | A | * | 9/1994 | Rohrmoser | 280/617 |
| 5,344,179 | A | | 9/1994 | Fritschi et al. | |
| 5,611,559 | A | * | 3/1997 | Luitz et al. | 280/617 |
| 5,924,717 | A | * | 7/1999 | Janisch et al. | 280/602 |
| 6,471,235 | B1 | * | 10/2002 | Luitz et al. | 280/618 |
| 6,824,158 | B1 | * | 11/2004 | Keller et al. | 280/618 |
| 6,848,704 | B2 | * | 2/2005 | Lucas | 280/613 |
| 7,036,842 | B2 | * | 5/2006 | Krumbeck et al. | 280/618 |
| 7,275,757 | B2 | * | 10/2007 | Hoesl et al. | 280/617 |
| 2002/0101060 | A1 | * | 8/2002 | Gorza et al. | 280/611 |
| 2003/0001363 | A1 | * | 1/2003 | Battistella et al. | 280/618 |
| 2003/0151230 | A1 | * | 8/2003 | Lucas | 280/613 |
| 2005/0212262 | A1 | * | 9/2005 | Hoesl et al. | 280/611 |
| 2005/0248129 | A1 | * | 11/2005 | Pelchat | 280/629 |
| 2006/0091643 | A1 | * | 5/2006 | Buquet et al. | 280/607 |

FOREIGN PATENT DOCUMENTS

| | | | | |
|---|---|---|---|---|
| DE | 3122468 | A | * | 4/1982 |
| DE | 41 35 899 | A1 | | 6/1992 |
| EP | 1 360 977 | A1 | | 11/2003 |
| FR | 2 825 285 | | | 12/2005 |
| WO | 02/49728 | A1 | | 6/2002 |
| WO | 2005/014124 | A1 | | 2/2005 |

* cited by examiner

DEVICE FOR POSITIONING A SKIBINDING ON A SKI

The invention relates to an arrangement by means of which a ski binding having two ski-binding parts is positioned on a ski, which bears guide devices for arranging the two ski-binding parts for sliding action, it being possible for each ski-binding part to be connected to an, in particular strip-like connecting element, which connecting elements can be secured in relation to the ski, between the two ski-binding parts, by means of a locking device which is fixed relative to the ski and has at least one blocking element which can be engaged with, and disengaged from, toothing formations provided laterally on the connecting elements.

AT 411 735 B discloses a ski-binding system which has basic elements which are preassembled on the top side of the ski and have guide elements running in the direction of the longitudinal axis of the ski. A carrying plate with ski-binding parts arranged thereon is guided in each case on the guide elements, which carrying plates are connected to a locking device, which is arranged in a fixed manner relative to the ski, by means of a respective, essentially rod-like connecting part. This locking device has a blocking member interacting with toothing formations on the two connecting parts. The blocking member bears toothing formations which can be actuated in a rigidly coupled manner, engage in the toothing formation of each of the connecting parts essentially from the side, and essentially in a direction parallel to the top side of the ski, and are arranged on a common locking carriage. The locking carriage can be moved, via a guide-control means, by means of a slide which can be adjusted in the longitudinal direction of the ski. This known arrangement is of complex construction and comprises a large number of components which have to be coordinated with one another in functional terms.

EP 1 360 977 A discloses a securing system which can be fitted on the top side of a ski and is intended for a ski binding having two ski-binding parts, the ski-binding parts being arranged on carrying plates which can be slid along ski-mounted guide tracks. The carrying plates are provided with connecting rods which each extend in the direction of the other carrying plate and with which a fixing arrangement interacts, the actuation thereof causing elevations and/or recesses on the connecting rods and matching elevations and/or recesses on the fixing arrangement to engage in one another with locking action, or disengage from one another for release purposes, the two components moving relative to one another in a horizontal direction and/or parallel to the top side of the ski. The fixing arrangement has a fixing body on which an eccentric is mounted in a rotatable manner, this eccentric having to be rotated through 90° in order for the toothing formations of the connecting rods to be released from the toothing formations of the fixing body.

The object of the invention is for an arrangement of the type mentioned in the introduction to be constructed significantly more straightforwardly than known arrangements and for actuation to be made possible without the aid of a tool, the intention being for it to be possible to change or adapt the spacing between the ski-binding parts in a convenient and functionally reliable manner.

The object in question is achieved according to the invention in that the at least one blocking lever is mounted on a carrier part, which can be connected to the ski and remains connected when the spacing between the ski-binding parts is changed, such that it can be rotated about an axis running transversely to the longitudinal direction of the ski and in a plane parallel to the top side of the ski, and pivoting about the axis allows the carrier part to be engaged with, and disengaged from, the toothing formations of the connecting elements.

The arrangement according to the invention is designed in a very straightforward and therefore also functionally reliable manner since the blocking lever itself can be engaged with, and disengaged from, the toothing formations of the connecting elements simply by being pivoted manually up and down.

The connecting elements are, in particular, of strip-like design and are fitted and guided on the underside of the carrier part such that they run alongside one another. For handling purposes, the connecting elements thus advantageously form a unit together with the carrier part and the blocking lever mounted thereon.

For a compact construction of the arrangement, it is advantageous if the connecting elements are provided with the toothing formations on their mutually facing longitudinal sides.

The connecting elements can be connected to the ski-binding parts in a particularly straightforward manner. All that is required for this purpose is for a latching element or the like to be provided in each case on the one end sections of the connecting elements, the latching element allowing the connecting element to be connected, for example fitted, to a carrying plate fastened on the respective ski-binding part.

In the case of a preferred embodiment of the invention, a single blocking lever is provided and, on its side which is directed toward the top side of the ski, bears a blocking element with toothing formations which can be engaged with, and disengaged from, the toothing formations on the connecting elements. This variant is particularly space-saving, functionally reliable and straightforward.

In the case of another variant, two blocking levers are provided, each of which bears on its underside, which is directed toward the top side of the ski, a blocking element with a toothing formation, so that one blocking element can be engaged with, and disengaged from, one connecting element and the other blocking element can be engaged with, and disengaged from, the other connecting element.

The blocking element or elements can be engaged with the connecting elements through an opening in the carrier part. This opening is correspondingly adapted to the respective blocking element, so that, in the locked position, the opening can be completely covered by the blocking lever.

It is particularly advantageous to form on the periphery of the opening, or of the openings, toothing formations with which the toothing formations of the blocking lever, or of the blocking elements, can be engaged. In this way, the respective blocking element is retained in the locked position predominantly by the carrier part.

In the case of an embodiment with two blocking levers, it is advantageous for these to be arranged such that one blocking lever is coupled to the other blocking lever in terms of movement. The actuation of one blocking lever thus inevitably results in the second blocking lever being moved along and actuated therewith.

The carrier part, further preferably, is designed as a carrier plate extending between the carrying plates of the ski-binding parts in the longitudinal direction of the ski.

In the case of an arrangement designed according to the invention, it is possible for the guide device provided for arranging the carrying plates for sliding action to be fastened subsequently on the top side of the ski, following production of the ski; however, provision may also be made for the guide device to be arranged on or in the ski during production of the ski.

Figures 2, 3, 4:
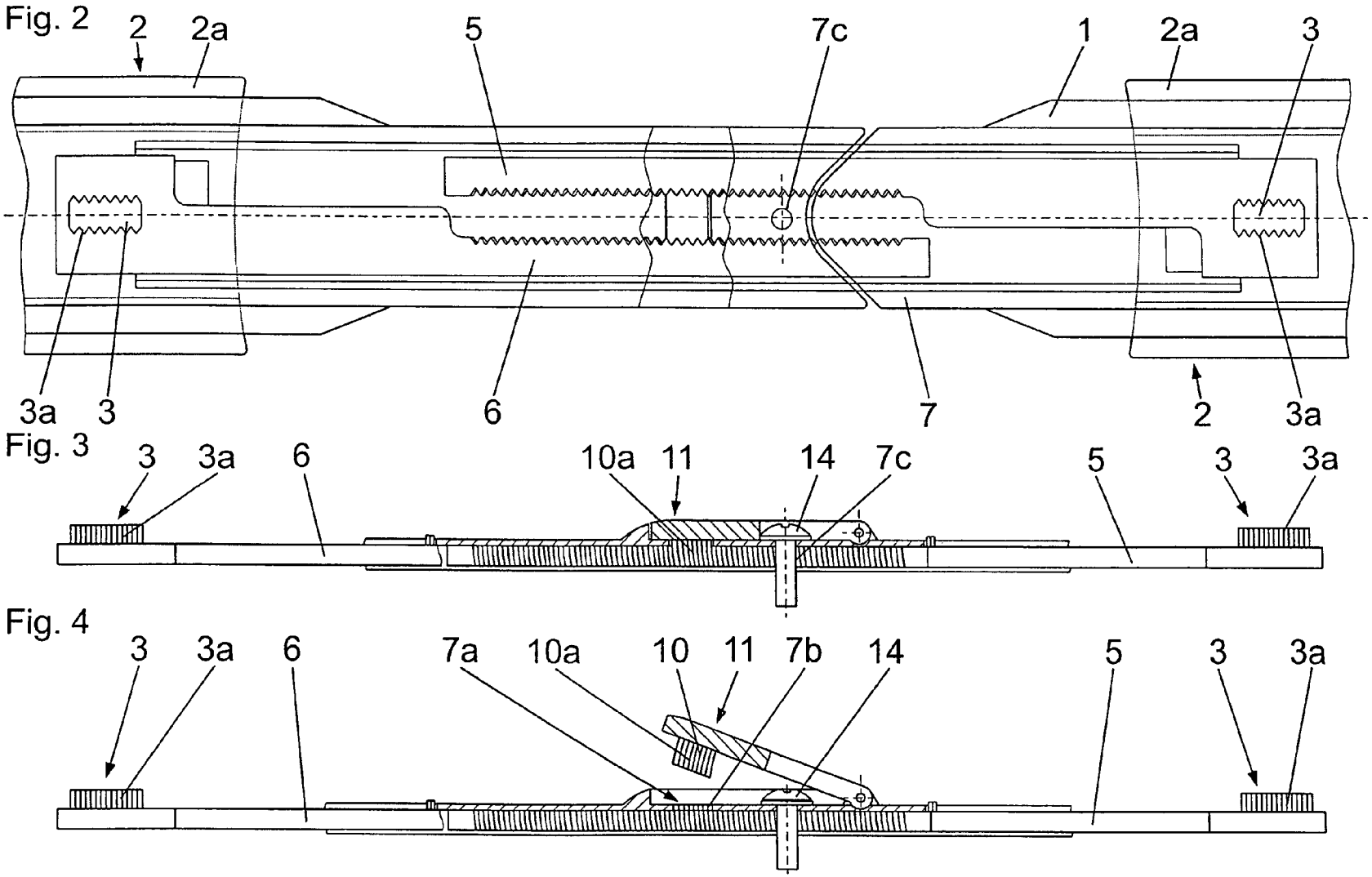
Figure 5:
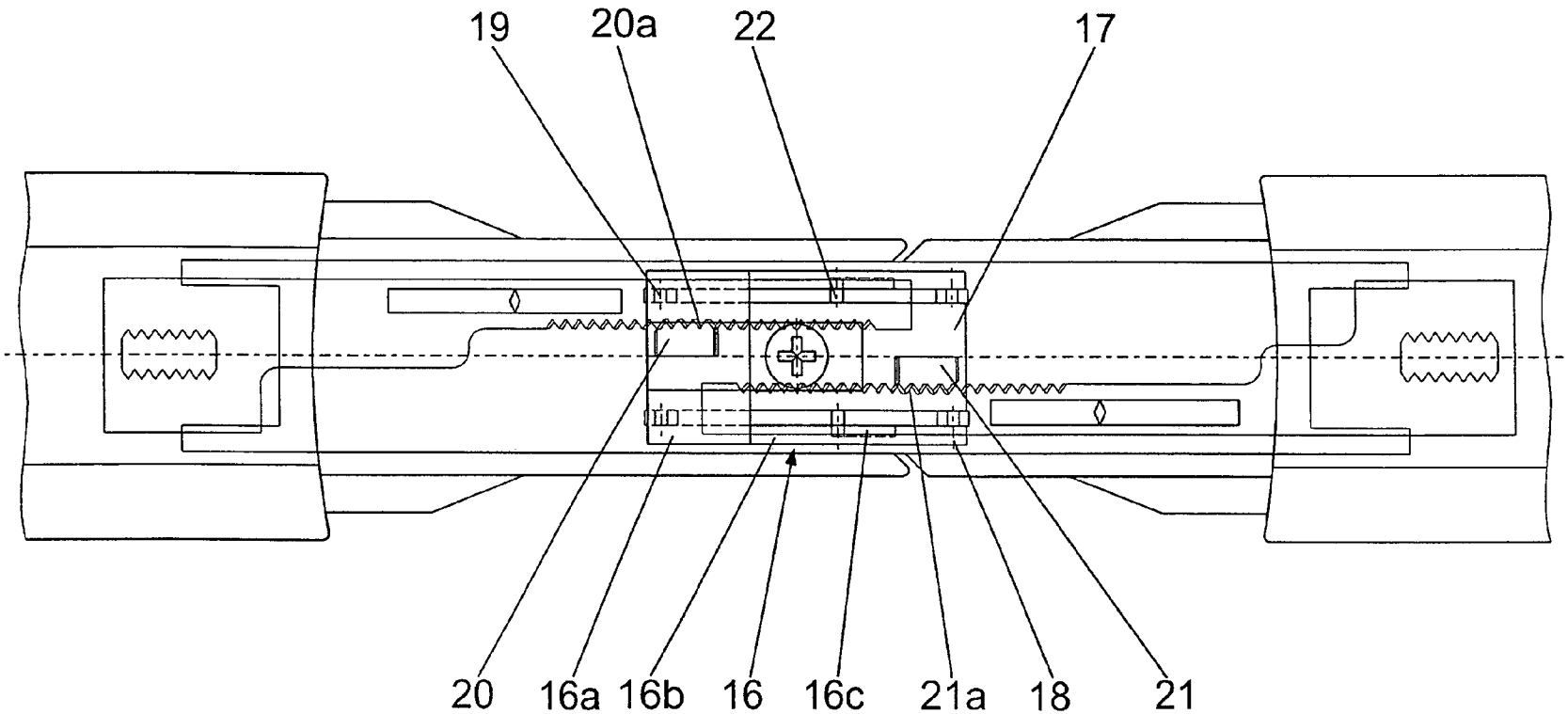
Figure 6:
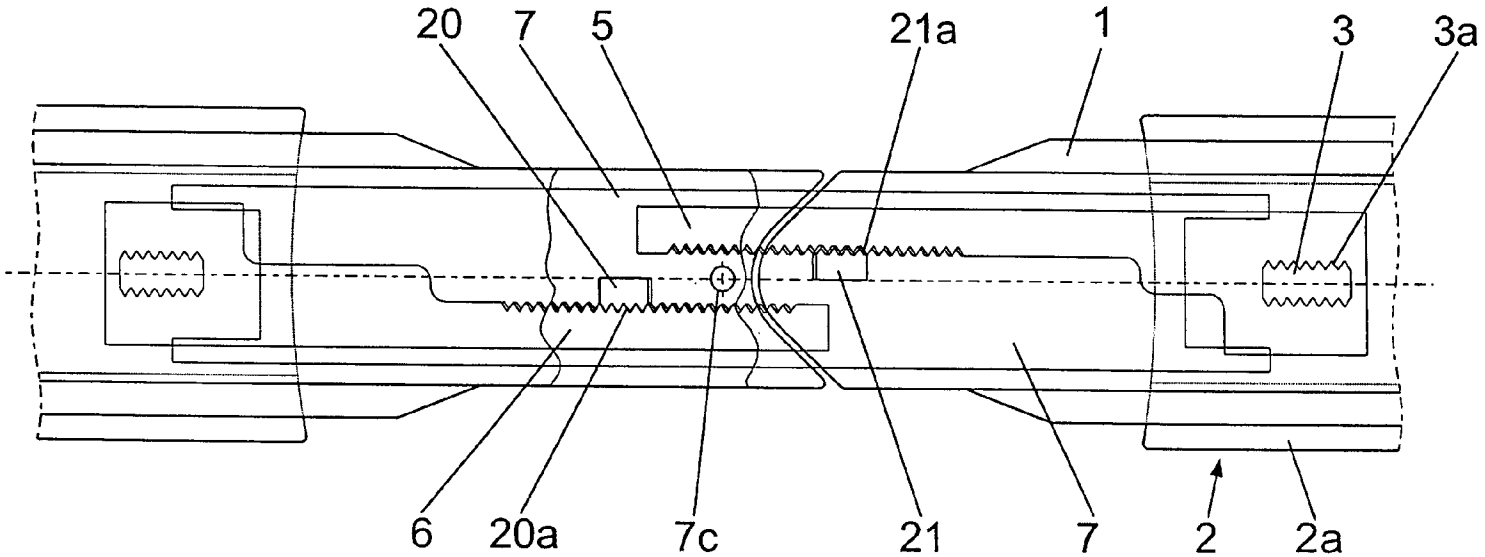
Figure 7:
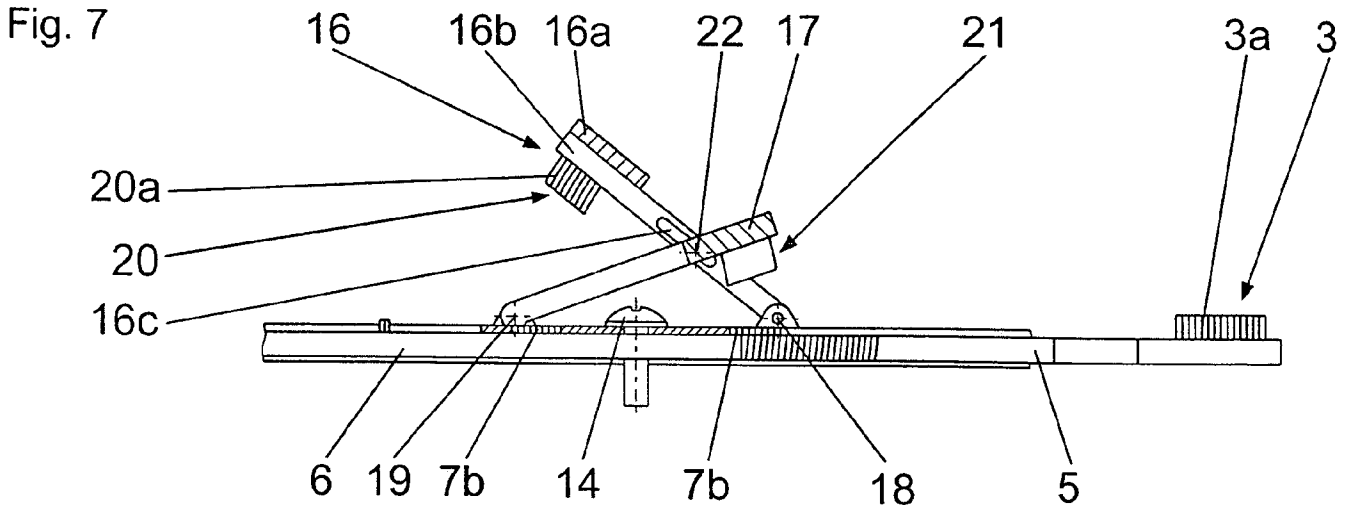

Further features, advantages and details of the invention will now be described in more detail with reference to the drawing, which illustrates a number of exemplary embodiments and in which:

FIG. 1 shows a plan view of a first embodiment of the invention,

FIG. 2 shows a bottom view of the essential constituent parts from FIG. 1, FIG. 3 shows a side view of a number of the components shown in FIG. 1, with the blocking lever locked, FIG. 4 shows a view according to FIG. 3 with the blocking lever open, FIGS. 5 to 7 show views of a second embodiment of the invention, in which case FIGS. 5 and 6 show views analogous to FIGS. 1 and 2, and FIG. 7 shows a side view of a number of components shown in FIGS. 5 and 6.

In FIGS. 1, 2, 5 and 6, covered components are illustrated using fine lines.

The arrangement according to the invention is provided for positioning, and adjusting in the longitudinal direction, a ski binding having two ski-binding parts: a toe piece and a heel grip. The ski-binding parts here can be arranged on guide devices which are fastened on the ski or are integrated in the ski. In the case of the embodiment illustrated, the guide devices are guide plates 1 which are fastened on the ski (not shown) and are indicated in FIGS. 1 and 2. The two guide plates 1 butt against one another in the central region of the arrangement and overlap with one another here over a short distance. On its side peripheries running in the longitudinal direction of the ski, each of the guide plates 1 is provided, in a manner known per se, with guide strips (not visible) onto which in each case one carrying plate 2 can be pushed, by way of correspondingly shaped guides 2*a*, such that it is secured against being lifted off from the respective guide plate 1, but remains capable of sliding action in the longitudinal direction of the guide plate 1 and of the ski. Fastened on each carrying plate 2 is one of the ski-binding parts, which can be designed in a manner known per se and are not included in the subject matter of this invention. As, in particular, FIG. 1 shows, a fitting or latching location 4 in the form of an opening or aperture for a respective latching element 3 of a front connecting element 5 and of a rear connecting element 6 is provided on each carrying plate 2. Each fitting or latching location 4 extends approximately in rectangular form in the longitudinal direction of the ski and is provided with a respective toothing formation 4*a* on its peripheries which run in the longitudinal direction of the ski. Each latching element 3 is a component which is located at the end section of the respective connecting element 5, 6 and has side surfaces which run in the longitudinal direction of the ski and are provided with toothing formations 3*a*, by means of which the latching element 3 can be engaged with the toothing formations 4*a* of the respective fitting or latching location 4. It is preferably possible here for the latching elements 3 to be placed just in a single position, as seen in the longitudinal direction of the ski.

The strip-like connecting elements 5, 6 run parallel to one another and, over most of their extent, alongside one another and are fitted and guided on the underside of a housing-like carrier plate 7 which, when mounted on the ski, extends in the longitudinal direction of the ski. The mutually facing longitudinal peripheries of the connecting elements 5, 6, these peripheries extending in the longitudinal direction of the ski, are each provided with a toothing formation 8, 9, the tooth spikes of which are oriented in a plane parallel to the top side of the ski. A blocking element 10 (see FIG. 4) of a blocking lever 11 can be engaged with, and disengaged from, the two toothing formations 8, 9. The blocking lever 11 is articulated such that it can be rotated around an axis 12 which runs at right angles to the longitudinal axis of a ski and is arranged on the carrier plate 7. The blocking element 10 is provided on the underside of the blocking lever 11, this underside being directed toward the top side of the ski, and has two side surfaces which run in the longitudinal direction of the ski and have toothing formations 10*a*, which can be engaged with the two toothing formations 8, 9 of the connecting elements 5, 6. For this purpose, the carrier plate 7 has formed in it an opening 7*a* which is adapted to the shape of the blocking element 10 and can be seen, for example, in FIG. 4; it is covered by the lever 11 in FIG. 1. Those two peripheries of the opening 7*a* which run in the longitudinal direction of the connecting elements 5, 6 are preferably provided with toothing formations 7*b*, which allow engagement of the toothing formations 10*a* of the blocking element 10. In the locked position, the toothing formations 10*a* of the blocking element 10 therefore engage simultaneously in the toothing formations 7*b* and in the toothing formations 8, 9 of the connecting elements 5, 6, the latter toothing formations 8, 9 being located beneath the toothing formations 7*b*. An accommodating bore 7*c* for a fastening screw 14 is provided in the central region of the carrier plate 7, beneath the blocking lever 11, so that the carrier plate 7 can be connected to one of the guide plates 1 and thus to the ski.

The top side of the carrier plate 7 is provided with markings 15 which allow the spacing between the ski-binding parts connected to the two connecting elements 5, 6 to be adjusted precisely to the sole lengths of ski boots.

The ski, which is not shown in the figures, is preferably supplied with preassembled guide plates 1 from the outset. The two connecting elements 5, 6, which are retained on the underside of the carrier plate 7, form a unit together with this carrier plate and the blocking element 10 of the blocking lever 11, the blocking element being latched in any desired position. In order to mount the two ski-binding parts (not shown) on the ski, the latching elements 3 at the end sections of the connecting elements 5, 6 are fitted or latched on the undersides of the carrying plates 2. The preassembled unit comprising ski-binding parts, connecting elements 5, 6 and carrier plate 7 can then be pushed onto the two guide plates 1 from one of the two sides. With the blocking lever 11 open or pivoted up, the carrier plate 7 is connected to one plate 1 by means of the screw 14. The task of adapting the spacing between the two ski-binding parts does not require the screw 14 to be released; all that is needed is for the two ski-binding parts to be displaced into the desired position on their guide plates 1, with the blocking lever 11 unlocked, and then for the blocking lever 11 to be pivoted in the direction of the top side of the ski, so that the blocking element 10 engages with the toothing formations 8, 9 of the two connecting elements 5, 6. The spacing between the two ski-binding parts can be changed in an analogous manner.

In the case of the variant which is shown in FIGS. 5 to 7, a pair of blocking levers 16, 17 which are oriented toward one another is provided instead of a single blocking lever. The other constituent parts of the arrangement may correspond to those of the embodiment shown in FIGS. 1 to 4 and are therefore not designated specifically. Each blocking lever 16, 17 is articulated such that it can be rotated about an axis 18, 19 which runs transversely to the longitudinal direction of the ski and is arranged in each case on the carrier plate 7, and, on its end section which is directed away from its axis of rotation 18, 19, each blocking lever bears a blocking element 20, 21 on its underside. The blocking element 20 can be engaged with the toothing formation 8 of the connecting element 5 and the blocking element 21 can be engaged with the toothing formation 9 of the other connecting element 6, and each thus has a side surface with a correspondingly designed toothing formation 20*a,* 21*a*. The two blocking levers 16, 17 are coupled to one another in terms of movement, as is shown, in particular, in FIG. 7. The blocking lever 16 is provided for actuating the arrangement, for activating and releasing the latching action, and has an actuating plate 16*a* and two lateral arms 16*b,* by means of which it is articulated about the axis 18. Each of the arms 16*b* is provided with a slot 16*c* or a slot-like aperture in which a respective guide pin 22, which is arranged on the blocking lever 17, engages. The blocking lever 17 is thus located centrally between the two arms 16*b* of the blocking lever 16. In order to release the locking of the blocking levers 16, 17 with the toothing formations 8, 9 of the connecting elements 5, 6, all that is required is for the blocking lever 16 to be raised, as a result of which the two blocking levers 16, 17, the blocking lever 17 by means of its guide pins 22, are disengaged from the toothing formations 8, 9 of the connecting elements 5, 6. It is also the case with this embodiment that the blocking levers 16, 17 project through corresponding apertures in the carrier plate 7, the apertures each being provided, on one of their longitudinal peripheries, with a toothing formation 7*b,* and these toothing formations, in the locked position, engage with the toothing formations 20*a,* 21*a*.

The invention is not restricted to the embodiments illustrated. It is thus possible, for example, for the guide devices for the carrying plates of the ski-binding parts to be accommodated in depressions in the ski and to have been installed here during production of the ski. The carrier plate is then screw-connected to the ski. The connecting elements may be connected to the carrying plates of the ski-binding parts in some other way to those which have been illustrated and described.

The invention claimed is:

1. Arrangement for positioning a ski binding having two ski-binding parts on a ski, the ski having guide devices for arranging the two ski-binding parts for sliding action, wherein the ski-binding parts can each be connected to a respective connecting element, which connecting elements can be secured in relation to the ski, between the two ski-binding parts, by means of a locking device which is fixed relative to the ski and has a blocking lever, wherein the blocking lever can be engaged with, and disengaged from, toothing formations provided laterally on the connecting elements;

wherein the blocking lever is mounted on a carrier part, which can be connected to the ski and remains connected to the ski when a spacing between the ski-binding parts is changed, such that the blocking lever can be rotated about an axis running transversely to the longitudinal direction of the ski and in a plane parallel to the top side of the ski, and wherein said rotation allows the blocking lever to be engaged with, and disengaged from, the toothing formations of the connecting elements;

characterized in that the blocking lever, on its side which is directed toward the top side of the ski, bears a blocking element with toothing formations which can be engaged with, and disengaged from, the toothing formations of the connecting elements;

characterized in that the blocking element can be engaged with the connecting elements through an opening in the carrier part; and characterized in that formed on the periphery of the opening are toothing formations with which the toothing formations of the blocking element can be engaged.

2. Arrangement according to claim 1, characterized in that the connecting elements are, of strip-like design and are fitted and guided on the underside of the carrier part such that they run alongside one another.

3. Arrangement according to claim 1, characterized in that the connecting elements are provided with the toothing formations on diametrically facing longitudinal sides.

4. Arrangement according to claim 1, characterized in that sections of the connecting elements which can be connected to the ski-binding parts each bear a latching element, by which the respective connecting element can be connected to the carrier part fastened on the respective ski-binding part.

5. Arrangement according to claim 4, characterized in that the carrier part is a carrier plate which extends between the carrying plates of the ski-binding parts in the longitudinal direction of the ski.

6. Arrangement according to one of claims 4 and 5, characterized in that the guide devices provided for arranging the carrying plates for sliding action are integrated on or in the ski during production of the ski.

* * * * *